US007819356B2

(12) United States Patent
Takatsuka et al.

(10) Patent No.: US 7,819,356 B2
(45) Date of Patent: Oct. 26, 2010

(54) METHOD AND APPARATUS OF CONNECTING STRIP-LIKE MATERIAL

(75) Inventors: Tomoyuki Takatsuka, Osaka (JP); Hirokatsu Mizukusa, Osaka (JP)

(73) Assignee: Toyo Tire & Rubber Co., Ltd., Osaka-shi (JP)

( * ) Notice: Subject to any disclaimer, the term of this patent is extended or adjusted under 35 U.S.C. 154(b) by 0 days.

(21) Appl. No.: 12/297,681

(22) PCT Filed: Apr. 21, 2006

(86) PCT No.: PCT/JP2006/308424

§ 371 (c)(1),
(2), (4) Date: Dec. 30, 2008

(87) PCT Pub. No.: WO2007/122725

PCT Pub. Date: Nov. 1, 2007

(65) Prior Publication Data

US 2009/0184192 A1 Jul. 23, 2009

(51) Int. Cl.
*B65H 67/00* (2006.01)

(52) U.S. Cl. ..... 242/559.3; 242/554

(58) Field of Classification Search ..... 242/555, 242/555.1, 558, 559, 559.3, 556, 551, 554
See application file for complete search history.

(56) References Cited

U.S. PATENT DOCUMENTS 4,214,467 A * 7/1980 Sankaran ..... 242/562.1
4,730,781 A * 3/1988 Richter et al. ..... 242/559.3

(Continued)

FOREIGN PATENT DOCUMENTS

JP 61857/1990 U 5/1990

(Continued)

OTHER PUBLICATIONS

International Search Report of PCT/JP2006/308424, Mailing Date of May 23, 2006.

*Primary Examiner*—William A Rivera
(74) *Attorney, Agent, or Firm*—Westerman, Hattori, Daniels & Adrian, LLP

(57) ABSTRACT

The invention enables to automatically connect a terminal end portion of a strip-like material drawn out from a winding member constituting an apparatus of supplying the strip-like material and a start end portion of a succeeding strip-like material, at supply support portions 1*a*, 1*b*, a strip-like material B is drawn out from one winding member Ba of a plurality of winding members Ba, Bb aligned on support shafts 2*a*, 2*b* to be supported thereby, a start end portion of the strip-like material B of other winding member Ba is made to be awaited at an awaiting portion 9*a*, at every time of finishing transporting the strip-like material B, the strip-like material B is temporarily stopped from being transported, during a time period of stopping to transport the strip-like material B, a start end portion of the strip-like material B of a succeeding winding member Ba is held by a hand apparatus 10 and transported from above the awaiting portion 9*a* to above a receiving base 7, the start end portion is laminated on a terminal end portion of the preceding strip-like material, and the start end portion and the terminal end portion are pressed to connect above the receiving base 7.

6 Claims, 5 Drawing Sheets

U.S. PATENT DOCUMENTS

| | | | | | |
|---|---|---|---|---|---|
| 4,882,006 | A | * | 11/1989 | Seki | 242/558 |
| 5,584,446 | A | * | 12/1996 | Delmore et al. | 242/555 |
| 2009/0032635 | A1 | * | 2/2009 | Marecki et al. | 242/559.3 |

FOREIGN PATENT DOCUMENTS

| | | | |
|---|---|---|---|
| JP | 4-308141 | A | 10/1992 |
| JP | 24844/1995 | U | 5/1995 |
| JP | 9-110245 | A | 4/1997 |
| JP | 11-099564 | A | 4/1999 |
| JP | 11-322144 | A | 11/1999 |
| JP | 2000-280373 | A | 10/2000 |
| JP | 2002-348004 | A | 12/2002 |

* cited by examiner

METHOD AND APPARATUS OF CONNECTING STRIP-LIKE MATERIAL

TECHNICAL FIELD

The present invention relates to a method and an apparatus of connecting a strip-like material for continuously drawing out and transporting a long strip-like material mainly used for fabricating a belt member for a tire or the like.

BACKGROUND ART

Regarding a belt member, used for, for example, a belt layer of a pneumatic tire, a reinforcement cord embedded in a rubber member constitutes a direction skewed to a tire peripheral direction, and therefore, a strip-like material embedded with reinforcement cords of a number of pieces of steel cords to align in a rubber member is cut skewedly by a length in correspondence with a belt width of a tire constituting an object of fabrication, and respective cut strip-like pieces are aligned such that cut ends thereof constitute both side edges to bond sides thereof to thereby fabricate the belt member.

The belt member in a prolonged shape fabricated as described above is temporarily wound in a roll-like shape, the belt member is cut by a predetermined length while drawing out by each predetermined length in a tire molding step and is used for molding a belt layer.

Further, in recent years, while fabricating a predetermined length of a belt member by successively bonding strip-like pieces cut skewedly as described above, the belt member is directly supplied to a molding drum to mold the belt layer (JP-A-11-99564 and JP-A-2000-280373).

Meanwhile, the strip-like material used for fabricating the belt member is fabricated by a step separate from a step of fabricating the belt member and is supplied to the step of fabricating the belt member in a state of being wound in a roll-like shape. Therefore, in order to continuously fabricate the belt member, it is necessary that while fabricating the belt member by drawing out the strip-like material from a member of winding the strip-like material, when a terminal end of the strip-like material of one winding member comes, the terminal end portion is connected with a start end portion of the strip-like material of a next winding member to continuously supply.

At this occasion, it is troublesome and takes time and labor to connect the terminal end portion of the strip-like material of the one winding member and the start end portion of the strip-like material of the next winding member by manual labor, further, occasionally, it is also necessary to temporarily stop driving an apparatus of fabricating the belt member, which is extremely inefficient. Particularly, in a case in which while fabricating a predetermined length of the belt member, the belt member is directly supplied to the molding drum to mold the belt layer, there is also a case in which a concern of temporarily interrupting molding of the tire is brought about.

The above-described problem is not limited to fabrication of the belt material but a similar problem is posed in fabricating other member constituting a material by a long strip-like material mainly embedded with cords in a rubber member, for example, in fabricating, for example, a carcass ply member or the like, in a case of connecting a terminal end of a strip-like material and a start end portion of a next strip-like material for continuously supplying the strip-like material.

Patent Reference 1: JP-A-11-99564
Patent Reference 2: JP-A-2000-280373

DISCLOSURE OF THE INVENTION

Problems that the Invention is to Solve

The invention has been carried out in order to resolve the above-described problem, when it is necessary to fabricate mainly the belt member for a tire or a carcass ply member or the like as described above, or supply continuously other long strip-like material, a terminal end portion of a strip-like material transported from an apparatus of supplying the strip-like material, for example, a strip-like material drawn out from, for example, a roll-like winding member and a start end portion of a next strip-like material are made to be able to be connected automatically to thereby enable continuous supply.

Means for Solving the Problems

The invention is characterized by a method of connecting a strip-like material including a plurality of supply apparatus for transporting a strip-like material continuously for continuously supplying the strip-like material by automatically connecting a terminal end portion of the strip-like material of one of the supply apparatus with a start end portion of the strip-like material of other of the supply apparatus, wherein when the terminal end portion of the strip-like material drawn out to transport from one of the supply apparatus is disposed on a receiving base on a front side in a transporting direction, the strip-like material is stopped temporarily from being transported and during a time period of stopping to transport the strip-like material, the start end portion of the strip-like material of other of the apparatus is carried onto the receiving base by a hand apparatus and the start end portion is connected to the terminal end portion of the preceding strip-like material.

Thereby, at every time of finishing transporting the strip-like material of one of the supply apparatus, the start end portion of the strip-like material of the succeeding supply apparatus can automatically be connected to the terminal end portion of the preceding strip-like material by carrying the start end portion to above the receiving base for connection by the hand apparatus. Accordingly, the strip-like material supplying operation can be carried out continuously.

Further, other of the invention is characterized by the method of connecting a strip-like material, wherein the supply apparatus is a winding member wound with the strip-like material in a roll-like shape for successively drawing out the strip-like material of each winding member from a supply support portion for supporting a plurality of the winding members in parallel to transport continuously, wherein the strip-like material is drawn out to transport from one of the winding members, and the start end portion of the strip-like material of other of the winding members is drawn out to an awaiting portion set on a front side in the transporting direction for each winding member to be awaited, and wherein when the terminal end portion of the drawn out strip-like material is disposed on a receiving base for connecting a further front side in the transporting direction of the awaiting portion, the strip-like material is temporarily stopped from being transported, and during a time period of stopping to transport the strip-like material, the start end portion of the strip-like material of other of the winding members is carried from above the awaiting portion to above the receiving base by the hand apparatus, and the start end portion and the terminal end portion of the preceding strip-like material are connected above the receiving base.

Thereby, at every time of finishing drawing out the strip-like material of one of the winding members in the roll-like shape, the start end portion of the succeeding winding member drawn out to be awaited at the awaiting portion can automatically be connected to the terminal end portion of the preceding strip-like material by being carried to above the receiving base for connection by the hand apparatus. Therefore, an operation of transporting the strip-like material l can continuously be carried out.

In the method of connecting the strip-like material, it is possible that at two of the supply support portions aligned on front and rear sides in the transporting direction, the plurality of winding members are respectively aligned on a support shaft to be supported thereby, the strip-like material is drawn out to transport from one of the winding members of one of the supply support portions, and the start end portions of the strip-like material of other of the winding members of one of the supply support portions and the plurality of winding members of other of the supply support portions are drawn out to above the awaiting portions set to the front side in the transporting direction to be awaited for the respective winding members, and wherein when the strip-like material of the respective winding members drawn out from one of the supply support portions has been finished from being drawn out and the terminal end portion of the strip-like material is disposed above the receiving base, the strip-like material is temporarily stopped from being transported and during a time period of stopping to transport the strip-like material, the start end portion of the strip-like material of one of the winding members of other of the supply support portions is carried from above the awaiting portion to above the receiving base by the hand apparatus, and the start end portion is connected to the terminal end portion of the preceding strip-like material.

In this case, at every time of finishing drawing out the strip-like material of the plurality of winding members supported by one of the supply support portions, the start end portion of the strip-like material of the winding member supported by other of the supply support portions can automatically be connected to the terminal end portion of the preceding strip-like material similar to the above-described by being carried to above the receiving base by the hand apparatus. Therefore, the strip-like material of the winding members supported by the respective front and rear supply support portions can continuously be drawn out to transport while being connected alternately for the respective supply support portions.

Further, an apparatus of connecting a strip-like material of the invention is for carrying out the above-described connecting method and as one thereof, characterized in including a plurality of supply apparatus capable of continuously transporting a strip-like material, a receiving base for connection provided to receive the strip-like material transported from the respective supply apparatus at a position on a front side of a side of transporting the strip-like material of a portion of installing the supply apparatus, a transporting apparatus provided to transport the strip-like material at a constant speed on a front side in the transporting direction of the receiving base and temporarily stop transporting the strip-like material when a terminal end portion of the strip-like material is disposed above the receiving base, a hand apparatus capable of being moved from a portion of transporting the strip-like material from each supply apparatus and the receiving base frontward therefrom for carrying a start end portion of the strip-like material of a successive one of the supply apparatus and laminating the start end portion to the terminal end portion of the preceding strip-like material when the terminal end portion of the strip-like material is disposed above the receiving base and temporarily stopped from being transported, and a hold apparatus for connection arranged on an upper side of the receiving base for pressing to connect the laminated portion by being moved down to the receiving base in a state of laminating the terminal end portion and the start end portion.

According to the connecting apparatus, at every time of finishing transporting the strip-like material from one of the supply apparatus, the start end portion of the strip-like material of other of the supply apparatus is transported to above the receiving base by the hand apparatus and is laminated to the terminal end portion of the preceding strip-like material to be automatically connected by pressing the laminated portion by the hold apparatus. Therefore, the method of connecting the strip-like material can preferably be carried out.

Further, other of the apparatus of connecting a strip-like material of the invention is characterized by the apparatus of connecting a strip-like material, wherein the apparatus of supplying the strip-like material is a winding member wound with the strip-like material in a roll-like shape, a plurality of the winding members are supported by the supply support portion in parallel for successively drawing out the strip-like material to continuously transport for each winding member from the supply support portion, the apparatus further comprises a support shaft for aligning the plurality of winding members of the strip-like material to movably support at a drawing out position for the respective winding members in the supply support portion, an awaiting portion for drawing out the start end portion of the strip-like material of the winding member to be awaited on a front side in the transporting direction of the supply support portion, a receiving base for connection provided to receive the strip-like material drawn out at a position on a front side in the transporting direction of the strip-like material of the supply support portion, a transporting apparatus provided to transport the strip-like material at a constant speed on a front side in the transporting direction of the receiving base and temporarily stop transporting the strip-like material when the terminal end portion of the strip-like material is disposed above the receiving base, a hand apparatus movable in an up and down direction and in a front and rear direction between the awaiting portion and the receiving base for laminating the start end portion on the terminal end portion of the preceding strip-like material by transporting the start end portion of the strip-like material of a succeeding one of the winding member moved to the drawing out position from above the awaiting portion to above the receiving base when the terminal end portion of the strip-like material is disposed above the receiving base to be stopped temporarily, and a hold apparatus arranged on an upper side of the receiving base for pressing the laminated portion by being moved down to the receiving base in a state of laminating the terminal end portion and the start end portion.

According to the connecting apparatus, at every time of finishing drawing out the strip-like material of one of the winding members, the succeeding winding member is moved successively to the drawing out position, the start end portion of the winding member is carried to above the receiving base for connection while being drawn out by being held by the hand apparatus to be laminated to the terminal end portion of the preceding strip-like material, and is automatically connected by pressing the laminated portion by the hold apparatus. Therefore, the method of connecting the strip-like material can preferably be executed.

Regarding the apparatus of connecting the strip-like material, it is possible that two of the supply support portions each including the support shaft are set on front and rear sides in the direction of transporting the strip-like material to be spaced apart from each other by an interval therebetween, the two supply support portions include awaiting portions for drawing out the start end portion of the strip-like material to be awaited on respective front sides thereof, and a receiving base for connection is provided on a front side of the awaiting portion of the supply support portion on the front side in the transporting direction, and wherein the hand apparatus is movable in an up and down direction and in a front and rear direction between the respective awaiting portions of the two supply support portions and the receiving base and provided to laminate the start end portion on the terminal end portion of the preceding strip-like material by transporting the start end portion of the strip-like material of one of the winding members of other of the supply support portions from above the awaiting portion to above the receiving base when the strip-like material of the respective winding members drawn out from one of the supply support portions have been finished being drawn out.

Thereby, when the strip-like material of the plurality of winding members supported by the support shaft in one of the supply support portions has been finished being drawn out, the start end portion of the strip-like material of the winding member supported by the support shaft at other of the supply support portions can automatically be connected to the terminal end portion of the preceding strip-like material similar to the above-described, and can continuously be transported while being connected successively alternately to the strip-like materials of the respective winding members supported by the respective supply support portions for the respective supply support portions. Further, during a time period of drawing out the strip-like material from one of the supply support portions, the winding member of the strip-like material can newly be supplied onto the support shaft of other of the supply support portions to be set to be able to draw out.

In the apparatus of connecting the strip-like material, it is possible that the support shaft of the supply support portion is constituted by being supported in a cantilever style in a horizontal state by a stay, a base portion of the stay is movable in an axial direction of the support shaft, and the respective strip-like materials are constituted to be drawn out by moving the winding member of the strip-like material on the support shaft successively to the predetermined drawing out position by moving the base portion. Thereby, the operation of drawing out and connecting the strip-like member of the winding member can continuously be carried out.

It is preferable that at the supply support portion, the awaiting portions for drawing out the start end portion of the strip-like material to be awaited are arranged in parallel respectively for the plurality of winding members supported by the support shaft and provided to move in accordance with moving the winding member to the predetermined drawing out position. Thereby, the operation of connecting the strip-like material for the respective winding members can automatically be carried out.

Further, in the apparatus of connecting the strip-like material, it is preferable that a sensor for detecting a terminal end of the strip-like material drawn out to above the receiving base is further included, wherein based on a signal of detecting the terminal end by the sensor, the strip-like material is temporarily stopped from being drawn out by the transporting apparatus, and the hand apparatus is provided to grab the start end portion of the strip-like material to transport to above the receiving base. Thereby, the terminal end portion of the strip-like material which has been finished being drawn out as described above and the start end portion of the succeeding strip-like material are excellently connected automatically.

There is preferably used the transporting apparatus in which the transporting apparatus comprises a drive roller and a hold roller constituting a pair, and is provided to squeeze the strip-like material between the two rollers to transport at a predetermined speed. In this case it is preferable to provide a dancer portion on a transporting side of the drive roller for transporting to be able to transport the drawn out strip-like material to a next step even when the drive roller is stopped.

ADVANTAGE OF THE INVENTION

According to the apparatus of connecting the strip-like material of the invention, when the strip-like material of the supply apparatus of the winding member or the like wound with the strip-like material mainly constituting an object of supplying in the roll-like shape is transported to supply to a next step, the strip-like material can continuously be supplied while successively automatically connecting the terminal end portion of the strip-like material transported precedingly and the start end portion of the succeeding strip-like material.

Therefore, manual labor for connecting the strip-like material is unnecessary, an operational efficiency is promoted, particularly, the strip-like member can continuously be supplied to a step of fabricating a belt member or the like used, for example, for a pneumatic tire, it is not necessary to temporarily stop driving a belt fabricating apparatus, and promotion of a fabrication efficiency can be achieved.

BEST MODE FOR CARRYING OUT THE INVENTION

Next, an embodiment of the invention will be explained based on examples shown by drawings.

An example of FIG. 1 through FIG. 3 shows an apparatus of connecting a strip-like material mounted with a portion 1 of supplying a material to a fabricating step of cutting, bonding or the like in an apparatus of fabricating a belt member for a tire. A strip-like material B used for fabricating a belt member for a tire mentioned above is a strip-like material constituted by aligning a plurality of pieces of reinforcement cords of steel cords or the like in a rubber member, which is ordinarily fabricated by a step separate from a step of fabricating a belt member, wound in a roll-like shape and supplied to the material supply portion 1 in a state of a winding member. Although the strip-like material B having a width of normally, 20 through 100 mm, preferably, 30 through 50 mm is used, there is naturally a case of a width out of the above-described range.

The material supply portion 1 is set with a supply support portion for supplying a plurality of winding members of the strip-like material B, which is provided to be able to continuously draw out the strip-like material B successively at respective winding members to transport to a later step of cutting or the like. That is, according to the example, the winding member is used as the apparatus of supplying the strip-like material B.

In the case of the illustrated example, two support supply portions 1*a*, 1*b* aligned to be spaced apart from each other by an interval therebetween on front and rear sides in a direction of transporting the strip-like material B are installed. The front and rear supply support portion 1*a*, 1*b* include support shafts 2*a*, 2*b* for aligning to support a plurality (4 pieces in the case of the drawing) of winding members Ba, Bb respectively wound with the strip-like material B in a roll-like shape at constant intervals, and provided such that the respective single winding members Ba, Bb are disposed at predetermined drawing out positions in a state of being supported by the support shafts 2*a*, 2*b* and successive ones of the winding members Ba, Bb are moved to the drawing out positions at every time of finishing drawing out the winding members Ba, Bb to thereby enable to draw out the strip-like material B of the winding members Ba, Bb disposed at the drawing out positions.

The support shafts 2*a*, 2*b* supported by a cantilever style in a horizontal state by constituting a direction orthogonal to the drawing out direction by stays 3*a*, 3*b*, base portions 4*a*, 4*b* of the stays 3*a*, 3*b* are provided movably in axial directions of the support shafts 2*a*, 2*b* and the respective strip-like materials B are constituted to be drawn out successively by moving the respective winding members Ba, Bb to the predetermined drawing out positions by moving the base portions 4*a*, 4*b*. Although as means for moving the base portions 4*a*, 4*b*, various drive mechanisms for moving can be utilized, in the case of the drawings, ball screw mechanisms 5*a*, 5*b* driven to rotate by servo motors are utilized.

A transport apparatus 16 comprising a transporting drive roller 6 and a hold roller 6*a* constituting a pair is provided on a front side in a direction of transporting the strip-like material B in the material supply portion 1, particularly, on a front side of the supply support portion 1*a* on a front side in the transporting direction, by driving to rotate the drive roller 6 by a motor or the like, the strip-like material B is made to be able to be transported at a predetermined speed by squeezing the strip-like material B between the two rollers 6, 6*a*. The drive roller 6 is controlled to be driven to temporarily stop when a terminal end of the drawn out strip-like material B is detected by a sensor described below. Normally, a front side of the transporting apparatus 16 is provided with a dancer portion 17 capable of temporarily storing the transported strip-like material B, which is constituted to be able to continuously transport the strip-like material B to a later step even when transporting by the drive roller 6 is temporarily stopped.

The supply support portions 1*a*, 1*b* are provided to be able to automatically connect a start end portion of the strip-like material B of the winding member Ba, Bb to a terminal end portion of the strip-like material B drawn out precedingly at every time of moving the winding members Ba, Bb to the predetermined drawing out positions by a constitution described below.

As a constitution therefor, there are provided awaiting portions 9*a*, 9*b* for drawing out start end portions of the respective strip-like materials B to await at upper positions on front sides in the transporting direction constituting portions of transporting the strip-like materials B from the respective supply support portions 1*a*, 1*b*, that is, upper positions slightly on front sides of directions of drawing out the strip-like materials B drawn out from the respective winding members Ba, Bb on the support shafts 2*a*, 2*b*. The awaiting portions 9*a*, 9*b* are made to be able to hold the start end portions of the strip-like materials B in a state of being pasted detachably by utilizing, for example, adherence of rubber.

The awaiting portions 9*a*, 9*b* are arranged to align for respective plural winding members Ba, Bb supported by the support shafts 2*a*, 2*b*, and provided to move by being accompanied by movement of the winding members Ba, Bb to the predetermined drawing out positions. Thereby, in a case of supporting the respective winding members Ba, Bb by the support shafts 2*a*, 2*b*, when the start end portions of the respective strip-like materials B are drawn to the respective awaiting portions 9*a*, 9*b* to await, the respective winding members Ba, Bb can successively be disposed at the drawing out positions as they are.

Further, a receiving base 7 for connection of receiving the strip-like material B drawn out by the drive roller 6 is provided at an interval reaching the transport apparatus of the drive roller 6 or the like further on a front side of the awaiting portion 9*a* of the supply support portion 1*a* on a front side in the transporting direction, and a hold apparatus 8 by an air cylinder or the like capable of moving down to press the receiving base 7 is provided on an upper side thereof.

Further, a hand apparatus 10 for holding a necessary length portion including the start end portion of the strip-like material B on the awaiting portion 9*a*, 9*b* by means of chuck, suction or the like to move onto the receiving base 7 is provided movably in an up and down direction and in a front and rear direction. The hand apparatus 10 is supported by a moving member 13 reciprocally moved in the front and rear direction by moving means 12 of a ball screw mechanism or the like rotated by a servo motor to be able to move in the up and down direction by way of extracting and retracting means of an air cylinder or the like, and is controlled to carry the start end portion of the strip-like material B by being pertinently moved between respective positions of the both awaiting portions 9*a*, 9*b* constituting transporting portions from the front and rear supply support portions 1*a*, 1*b* and a position of the receiving base 7.

Numeral 11 in the drawing designates a sensor of a photoelectric tube or the like for detecting the terminal end of the strip-like material B precedingly drawn out on the receiving base 7, and respective operations of temporarily stopping transporting by the drive roller 6, carrying the start end portion of the strip-like material B by the hand in being stopped transporting, pressing of the hold apparatus 8 are set to be controlled such that an operation of connecting the strip-like material B is carried out based on detecting signal of the sensor 11.

An explanation will be given of an operation of connecting the strip-like material B by the connecting apparatus having the above-described constitution. As shown by outline explanatory views of FIG. 4A, FIG. 4B, FIG. 4C, at either one of the front and rear supply support portions 1*a*, 1*b*, for example, at the front side supply support portion 1*a* as shown by the drawings, when the strip-like material B is drawn out to transport from one of the plurality of winding members Ba supported by the support shaft 2*a*, in a case in which the terminal end of the strip-like material B drawn out from the one winding member Ba precedingly is detected by the sensor 11 on the receiving base 7, the strip-like material B is temporarily stopped from being transported by stopping the drive roller 6 of the transporting apparatus 16. During a time period of stopping the transporting, the successive winding member Ba is moved to the position for drawing out, further, the hand apparatus 10 holds the start end portion (the start end portion awaited above the awaiting portion 9*a*) of the strip-like material B of the succeeding winding member Ba to move onto the receiving base 7, and laminates the start end portion onto the terminal end of the preceding strip-like material B on the receiving base 7. Further, the hand apparatus 10 returns to the original position and the hold apparatus 8 is moved down to press the laminated portion. Thereby, the terminal end portion of the preceding strip-like material B and the start end portion of the succeeding strip-like material B are automatically connected. When the connection is finished, the drive roller 6 of the transporting apparatus 16 is driven again to continuously draw out to transport the strip-like material B.

Further, when the drive roller 6 is stopped, by transporting an amount of storing the strip-like material B of the dancer portion 17 frontward from the transport apparatus 16, supply of the strip-like material B to a later step is continuously carried out.

The above-described operation of connecting the strip-like material B is carried out similarly also when the strip-like material B is drawn out to transport from the winding member Bb at the rear side supply support portion 1*b*.

Further, when all of the strip-like material B of the plurality of winding members Ba or Bb respectively supported by the support shaft 2*a* or 2*b* on one side of the front and rear supply support portions 1*a*, 1*b* has been finished being drawn out, as shown by outline explanatory views of FIG. 5A, FIG. 5B, when the terminal end of the final strip-like material B of the supported winding member is detected by the sensor 11, similar to the above-described, the start end portion of the strip-like material B of the winding member Bb or Ba on the support shaft 2*b* or 2*a* on other side is held by the hand apparatus 10 to move onto the receiving base 7 and is automatically connected to the terminal end of the preceding strip-like material B by the hold apparatus 8. Thereby, the operation of drawing out and transporting the strip-like material B can be continued and can continuously be supplied to the later step.

Further, during a time period of drawing out the strip-like material B from the one supply support portion 1*a* or 1*b*, the winding member Bb or Ba of the strip-like material B can newly be supplied to be set to be able to draw out on the support shaft 2*b* or 2*a* of the other supply support portion 1*b* or 1*a*.

In supplying the strip-like material to the support shafts 2*a*, 2*b* of the front and rear supply support portions 1*a*, 1*b*, as shown in FIG. 3, the plurality of winding members Ba, Bb of the strip-like material B may be supported on a cantilever support shaft 15 on a carriage 14, when the strip-like material B on the support shaft 2*a*, 2*b* is expired, the carriage 14 may be moved and one end portion of the support shaft 15 may be engaged to be connected with an end portion of the support shaft 2*a* or 2*b*, the winding member Ba, Bb may be slid to transfer onto the support shaft 2*a* or 2*b* to be supported thereby.

Further, the strip-like material B drawn out to transport from the material supply support portion 1 can also be transported as it is in the drawing out direction other than transporting the strip-like material B to the later step of cutting or bonding or the like for fabricating a belt by changing the direction to an upper side.

Further, although according to the above-described example, there is shown an example of the connecting apparatus to continuously supply the strip-like material B to the later step of cutting or bonding or the like in the apparatus of fabricating the belt member for the tire, the apparatus of connecting the strip-like member of the invention is applicable also to a case of fabricating a member comprising a long strip-like material of a carcass ply member or the like other than fabrication of the belt member.

Further, although in the above-described example, there is shown a case of successively connecting the strip-like material B to transport to continuously supply by using the winding member Ba, Bb wound with the strip-like material B in the roll-like shape as a plurality of supply apparatus of continuously transporting the strip-like material B, the invention is not limited to that of using the winding member in the roll-like shape but can be embodied by using other supply apparatus capable of continuously transporting the strip-like material. As such an supply apparatus, there is an apparatus of transporting the strip-like material while forming the strip-like material by coating a rubber member while running a plurality of pieces of reinforcement cords of steel cords or the like in parallel, or an apparatus of transporting a strip-like material comprising a rubber member extruded to be molded in a strip-like shape by an extruder, and a plurality of the apparatus (supply apparatus) are installed by being aligned on front and rear sides in the transporting direction or transversely.

Also in this case, similar to the above-described example, when the terminal end portion of the strip-like material transported from one supply apparatus is disposed on the receiving base on the front side in the transporting direction, the strip-like material is temporarily stopped from being transported, and during a stop time period, a start end portion of the strip-like material of other one supply apparatus is carried up to the receiving base by the hand apparatus, and the apparatus can be embodied by being constituted to connect the start end portion to the terminal end portion of the preceding strip-like material by pressing by the press apparatus.

INDUSTRIAL APPLICABILITY

The apparatus of connecting the strip-like material of the invention can preferably be utilized when it is necessary to supply continuously a long strip-like material for fabricating a belt member for a tire or a carcass ply member or the like.

DESCRIPTION OF REFERENCE NUMERALS AND SIGNS

Figure 1:
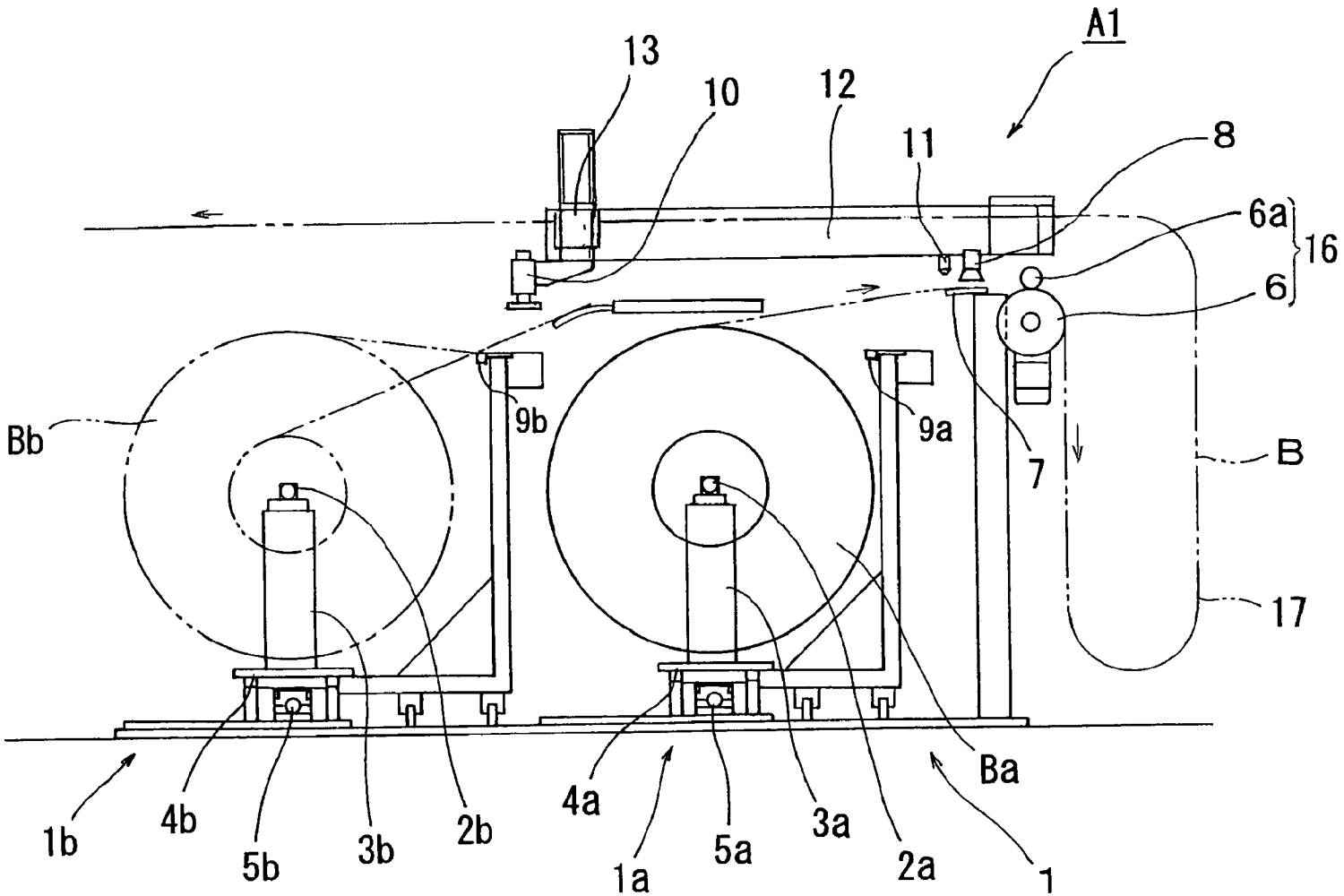
FIG. 1 is an outline side view showing an example of an apparatus of connecting a strip-like material of the invention.
Figure 2:
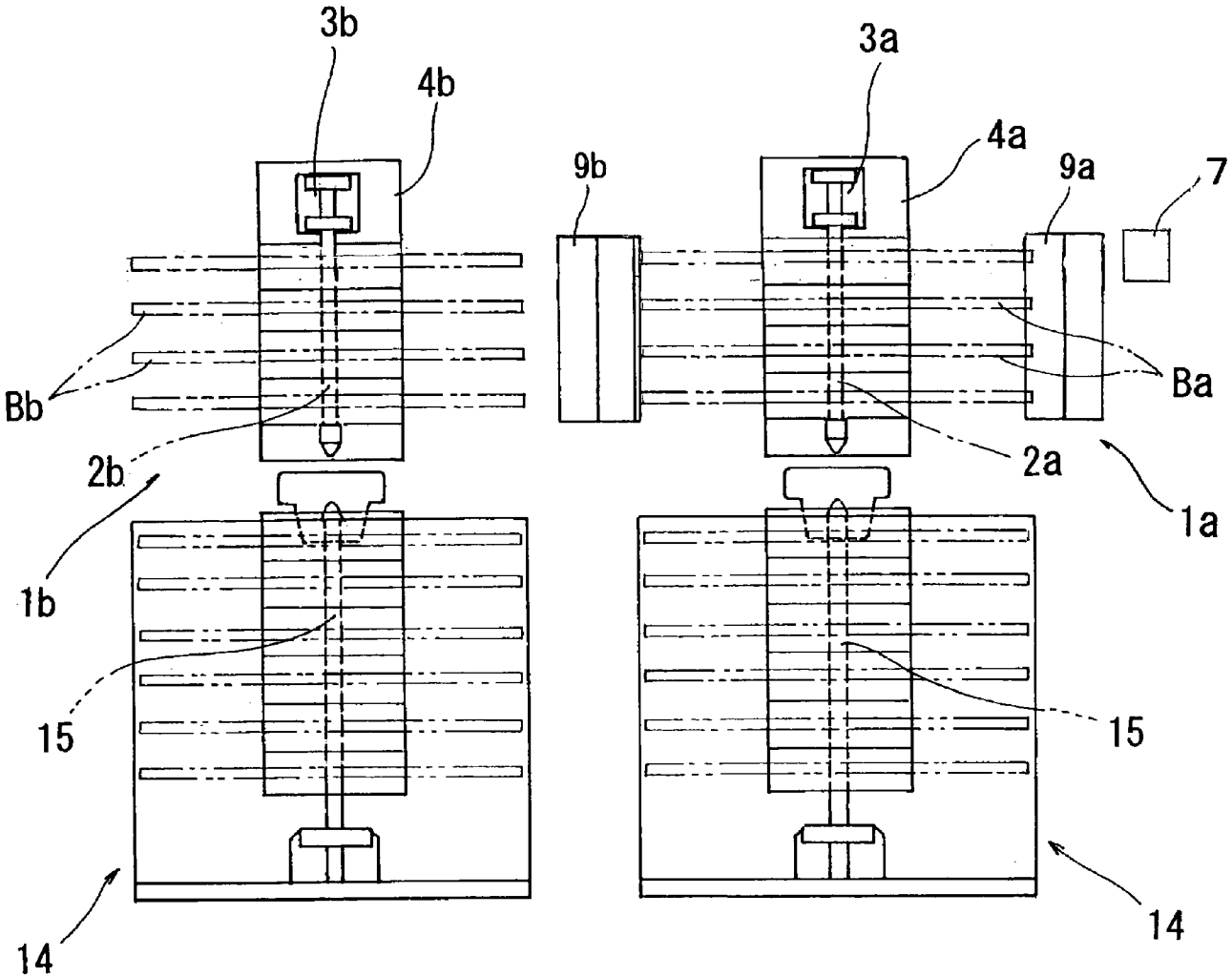
FIG. 2 is an outline plane view of the apparatus.
Figure 3:
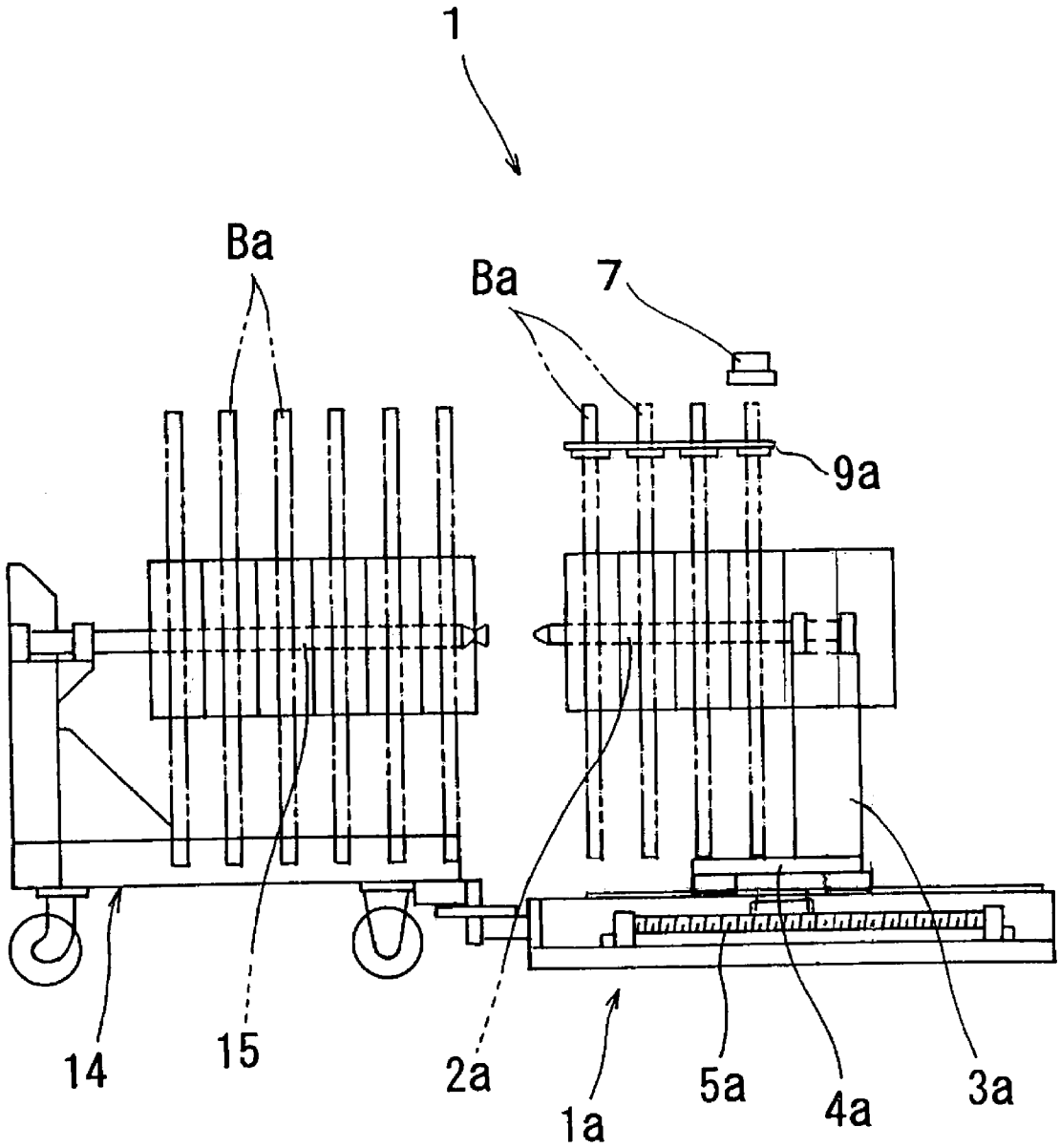
FIG. 3 is a front view of the apparatus from a transporting direction.
Figure 4A:
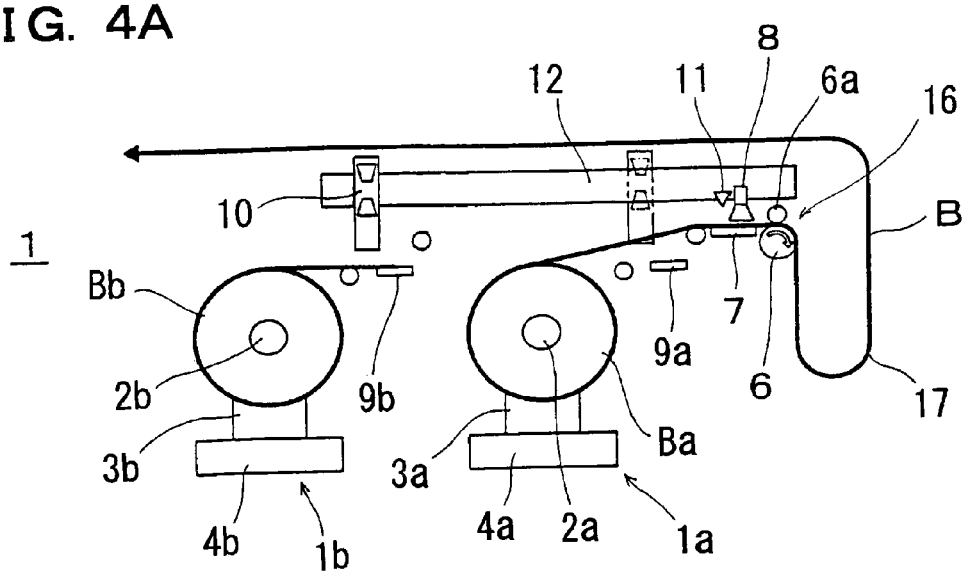
FIG. 4A is an outline side view of a state of transporting a normal strip-like material of the apparatus.
Figure 4B:
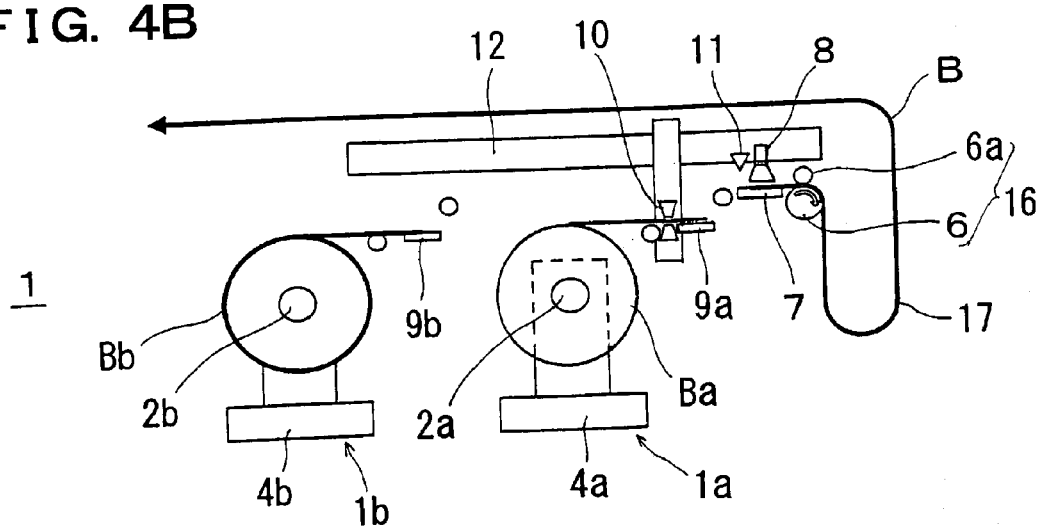
FIG. 4B is an outline side view before connection for explaining a state of automatically connecting the strip-like material of the apparatus.
Figure 4C:
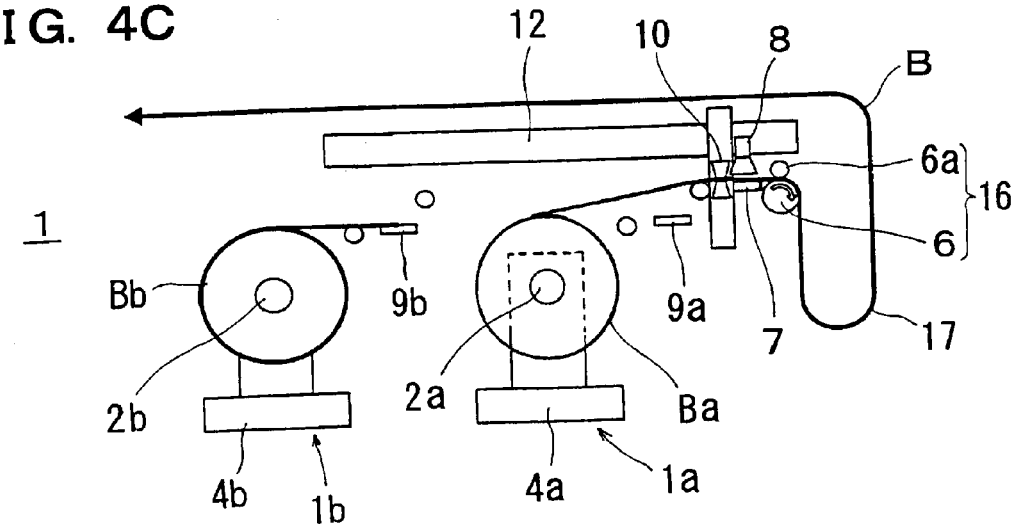
FIG. 4C is an outline side view in connecting of the apparatus.
Figure 5A:
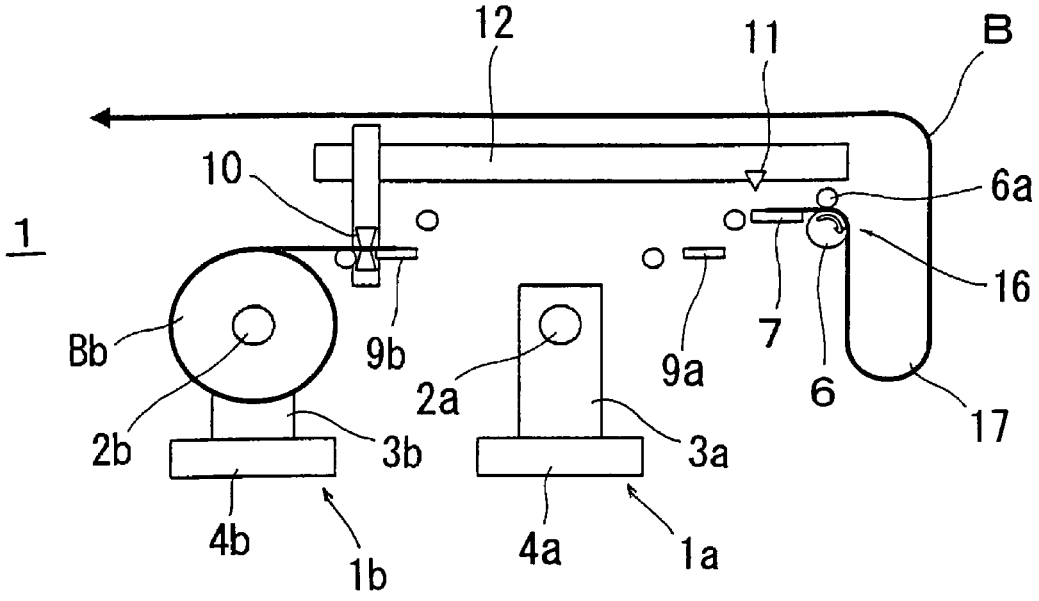
FIG. 5A is an outline side view before connection for explaining a state of automatically connecting a strip-like material at two supply support portions of the apparatus.
Figure 5B:
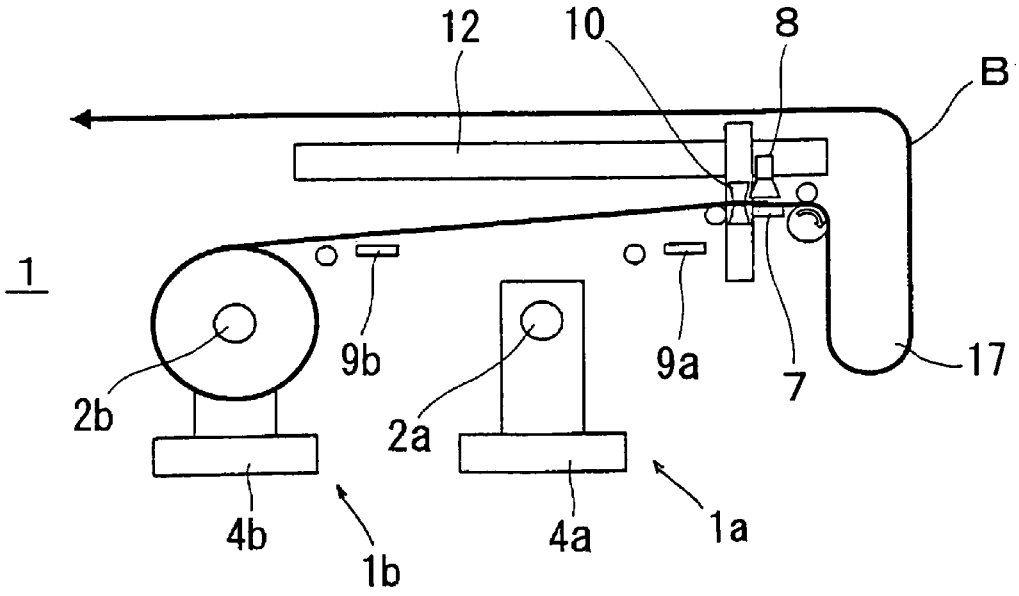
FIG. 5B is an outline side view in connecting of the apparatus.

B . . . strip-like material, Ba, Bb . . . winding members, 1 . . . material supply portion, 1*a*, 1*b* . . . supply support portions, 2*a*, 2*b* . . . support shafts, 3*a*, 3*b* . . . stays, 4*a*, 4*b* . . . base portions, 5*a*, 5*b* . . . ball screw mechanisms, 6 . . . drive roller, 6*a* . . . hold roller, 7 . . . receiving base, 8 . . . hold apparatus, 9*a*, 9*b* . . . awaiting portions, 11 . . . sensor, 10 . . . hand apparatus, 12 . . . moving means, 13 . . . moving member, 14 . . . carriage, 15 . . . support shaft, 16 . . . transporting apparatus, 17 . . . dancer portion

The invention claimed is:

1. A method of connecting a strip-like material, comprising:

providing two supply support portions, each of which supports a plurality of supply apparatuses of a strip-like material on a support shaft thereof, said two supply support portions each including an awaiting portion on the front side thereof to which a start end portion of the strip-like material is drawn out;

supplying a strip-like material from a first supply apparatus from a first one of said two supply support portions;

drawing out the start end portion of the strip-like material of a second supply apparatus of the first one of said two supply support portions to a position above said awaiting portion of the first one of said two supply support portions, while the strip-like material is being transported from the first supply apparatus of the first one of said two supply support portions;

detecting a presence of a terminal end of the strip-like material from said first supply apparatus of the first one of said two supply support portions on a receiving base;

temporarily stopping supply of the strip-like material from the first supply apparatus of the first one of said two supply support portions when a terminal end of the strip-like material from the first supply apparatus of the first one of said two supply support portions is detected on said receiving base;

during the temporary stopping, carrying a start end portion of a strip-like material from the second supply apparatus of the first one of said two supply support portions to said receiving base using a hand apparatus;

connecting the start end portion of the strip-like material from the second supply apparatus of the first one of said two supply support portions to the terminal end portion of the strip-like material from the first supply apparatus of the first one of said two supply support portions;

detecting a presence of a terminal end of the strip-like material from a final supply apparatus of the first one of said two supply support portions on said receiving base;

temporarily stopping supply of the strip-like material from the final supply apparatus of the first one of said two supply support portions when a terminal end of the strip-like material from the final supply apparatus of the first one of said two supply support portions is detected on said receiving base;

during the temporary stopping, carrying a start end portion of a strip-like material from a first supply apparatus of a second one of said two supply support portions to said receiving base using a hand apparatus; and connecting the start end portion of the strip-like material from the first supply apparatus of the second one of said two supply support portions to the terminal end portion of the strip-like material from the final supply apparatus of the first one of said two supply support portions, wherein said two supply support portions are disposed such that one of the two supply support portions is in front of the other, in the transporting direction, and wherein said receiving base is disposed in front of said two supply support portions, in the transporting direction.

2. An apparatus of connecting a strip-like material, comprising:

a plurality of supply apparatuses capable of continuously transporting a strip-like material, said supply apparatuses being wound in a roll-like shape;

two supply support portions disposed such that one of the two supply support portions is in front of the other, in the transporting direction, and such that said two supply support portions are spaced apart from each other with an interval therebetween, each of said two supply support portions supporting said plurality of supply apparatuses in parallel, each of said two supply support portions including a support shaft which aligns the plurality of supply apparatuses to be able to draw out the strip-like material and to be able to move successively to a predetermined drawing out position, and an awaiting portion on the front side of each of said two supply support portions to which a start end portion of the strip-like material is drawn out;

a receiving base provided to receive the strip-like material transported from the supply apparatuses, at a position in front of both of said awaiting portions, in the transporting direction;

a transporting apparatus provided to transport the strip-like material at a constant speed on a front side, in the transporting direction, of said receiving base and which temporarily stops transporting the strip-like material when a terminal end portion of the strip-like material is disposed above the receiving base;

a hand apparatus movable in an up-and-down direction and in a front-and-rear direction between each of said awaiting portions of said two supply support portions and said receiving base, for laminating the start end portion on a terminal end portion of a preceding strip-like material by transporting the start end portion of the strip-like material on said awaiting portion to a position above said receiving base; and a hold apparatus arranged on an upper side of said receiving base which presses and connects a laminated portion by moving downwards towards said receiving base in a state of laminating the terminal end portion and the start end portion of the strip-like materials, wherein when a terminal end portion of the strip-like material drawn out from a first supply apparatus of a first one of said two supply support portions is disposed above the receiving base, said hand apparatus laminates a start end portion of the strip-like material from a second supply apparatus of the first one of said two supply support portions on the terminal end portion of the strip-like material from the first supply apparatus of the first one of said two supply support portions by transporting the start end portion of the strip-like material from the second supply apparatus of the first one of the two supply support portions from the awaiting portion of the first one of the two supply support portions to a position above said receiving base, and wherein when a terminal end portion of the strip-like material drawn out from a final supply apparatus of the first one of said two supply support portions is disposed above the receiving base, said hand apparatus laminates a start end portion of the strip-like material from a first supply apparatus of a second one of said two supply support portions on the terminal end portion of the strip-like material from the final supply apparatus of the first one of said two supply support portions by transporting the start end portion of the strip-like material from the first supply apparatus of the second one of the two supply support portions from the awaiting portion of the second one of the two supply support portions to a position above said receiving base.

3. The apparatus according to Claim 2, wherein the support shafts of said two supply support portions are supported in a cantilever style in a horizontal state by a stay, a base portion of the stay is movable in an axial direction of the support shaft, and the respective strip-like materials are configured to be drawn out by successively moving the supply apparatuses on the support shafts to a predetermined drawing out position by moving the base portion.

4. The apparatus according to Claim 2, wherein said awaiting portions of said two supply support portions are arranged in parallel, and in accordance with the plurality of supply apparatuses of the strip-like material supported by the support shaft, and wherein said awaiting portions are movable in accordance with moving of said supply apparatuses to the predetermined drawing out position.

5. The apparatus according to Claim 2, the apparatus further comprising:

a sensor for detecting a terminal end of the strip-like material drawn out to above the receiving base;

wherein based on a signal of detecting the terminal end by the sensor, the strip-like material is temporarily stopped from being drawn out by the transporting apparatus, and the hand apparatus is provided to grab the start end portion of the strip-like material to transport to above the receiving base.

6. The apparatus according to Claim 2, wherein the transporting apparatus comprises a drive roller and a hold roller constituting a pair, and is provided to squeeze the strip-like material between the two rollers to transport at a predetermined speed.

* * * * *